US005839634A

United States Patent [19]

Pollard et al.

[11] Patent Number: 5,839,634

[45] Date of Patent: Nov. 24, 1998

[54] BLADE FOR SEVERING SHEET MATERIALS

[75] Inventors: Ricky Alan Pollard, Moscow; Randy Allen Eyre, Sardinia; Charles John Berg, Jr., Wyoming, all of Ohio

[73] Assignee: The Procter & Gamble Co., Cincinnati, Ohio

[21] Appl. No.: 789,360

[22] Filed: Jan. 27, 1997

[51] Int. Cl.[6] ..... B26F 3/02

[52] U.S. Cl. ..... 225/39; 225/77; 225/92

[58] Field of Search ..... 225/39, 77, 91, 225/92; 83/613, 614, 623, 627

[56] References Cited

U.S. PATENT DOCUMENTS

| | | | |
|---|---|---|---|
| 1,915,736 | 6/1933 | Hurlbut . | |
| 1,991,812 | 2/1935 | Marcalus | 206/58 |
| 4,292,871 | 10/1981 | Neumeyer et al. | 83/661 |
| 4,399,935 | 8/1983 | Nelder | 225/49 |
| 4,426,029 | 1/1984 | Kamp | 225/49 |
| 4,450,996 | 5/1984 | Kamp | 225/43 |
| 4,502,484 | 3/1985 | Giampapa et al. | 128/317 |
| 4,506,816 | 3/1985 | Roccaforte | 225/48 |
| 4,823,467 | 4/1989 | Campbell et al. | 30/355 |
| 4,913,767 | 4/1990 | Longworth | 156/527 |
| 5,078,311 | 1/1992 | Taguchi et al. | 225/43 |

FOREIGN PATENT DOCUMENTS

| | | | |
|---|---|---|---|
| 647015 | 4/1964 | Belgium . | |
| 768506 | 10/1967 | Canada . | |
| 0 546 392 A1 | 6/1993 | European Pat. Off. | B26F 1/44 |

*Primary Examiner*—Maurina T. Rachuba
*Attorney, Agent, or Firm*—William Scott Andes; E. Kelly Linman; Jacobus C. Rasser

[57] ABSTRACT

The present invention relates to improved blades for severing sheet materials such as polymeric sheets, metallic foils, and other sheet materials, particularly those suitable for use in the containment and protection of various items including perishable materials. The present invention provides an improved blade for severing sheet materials wherein design parameters for the design of the blade teeth have been tailored for improved severing performance. The blade comprises a blade body and a plurality of individual teeth extending outwardly from the blade body. The teeth each have a finite tooth radius and at least one tooth parameter selected from the group of optimized tooth parameters consisting of a tooth radius less than about 0.005 inches, a tooth pitch of less than about 0.050 inches, and a tooth thickness of less than about 0.006 inches. In a preferred embodiment of a blade in accordance with the present invention, at least two tooth parameters are selected from the group of optimized tooth parameters, and even more preferably three tooth parameters are selected from the aforementioned group of tooth parameters. Blades in accordance with the present invention may be unitary or composite structures and may be constructed in accordance with conventional fabrication techniques from a wide variety of commonly-available materials. Severing blades in accordance with the present invention may be affixed to and utilized in combination with a carton or container of generally conventional design for containing and dispensing a sheet material from a continuous web or utilized independently of a dispensing product container either as a hand-held implement or affixed to any stationary object, depending upon the operating environment. Such blades may be utilized to sever a wide variety of sheet materials, including two- and three-dimensional polymeric sheet materials.

20 Claims, 3 Drawing Sheets

BLADE FOR SEVERING SHEET MATERIALS

FIELD OF THE INVENTION

The present invention relates to improved blades for severing sheet materials such as polymeric sheets, metallic foils, and other sheet materials, particularly those suitable for use in the containment and protection of various items including perishable materials. The present invention further relates to such blades which exhibit improved efficacy in use, particularly with comparatively lower modulus sheet materials.

BACKGROUND OF THE INVENTION

Sheet-like materials for use in the containment and protection of various items, as well as the preservation of perishable materials such as food items, are well known in the art. Such materials can be utilized to wrap items individually and/or can be utilized to form a closure for a semi-enclosed container.

One class of such materials in common use today comprises those of various compositions formed into a thin, substantially two-dimensional, conformable web commonly supplied in rolled form. Common examples of such materials are polyvinyl chloride (PVC), polyvinylidene chloride (PVDC), polyethylene (PE), polypropylene (PP), aluminum foil, coated (waxed, etc.) and uncoated paper, and the like.

In the art of severing webs or sheets of materials, two main approaches have evolved. The first involves utilizing a blade which translationally moves relative to the surface of the material in a sawing motion to tear or shear the material in the desired location. The second involves utilizing a blade against which the material is drawn to cause a controlled tearing of the material.

The first approach is commonly utilized for comparatively more rigid (comparatively higher modulus) and thicker materials (wood, cardboard, metallic structures, etc.) which do not typically tear continuously once tearing is initiated. Toothed blades, typically sharpened, are often utilized to facilitate or accelerate the cutting process by shearing small pieces from the material to create a kerf along the desired separation line and eventually remove sufficient material for separation.

The second approach is commonly utilized for comparatively less rigid (comparatively lower modulus) and thinner materials (plastic sheets and films, paper, metallic foils) which exhibit a greater tendency to initiate and sustain tearing once tearing has begun. Sharpened or non-sharpened toothed blades are commonly employed to facilitate tearing of the material by piercing the material with one or more teeth and then tensioning the material between teeth beyond its tensile limits. Thus, the material between each adjacent pair of teeth is torn in short segments between piercings. To concentrate the forces on a sufficiently small area/small number of teeth, the sheet material is typically pulled at an angle across the edge of the blade such that the sheet material partially wraps the edge of the blade and that the forces are concentrated at one portion, often one edge, of the sheet material. For materials with a sufficiently high modulus (such as kraft paper), a non-toothed, non-sharpened blade may be employed if sufficient force may be concentrated at the edge of the paper to start the tearing process.

Blades of the second variety for use by the end user in severing the desired length or quantity of sheet material from a continuous roll have been developed and are in common use today. Such blades attempt to balance the desired attributes of safety in handling and efficacy in use. More particularly, such blades attempt to minimize the likelihood that a user will experience personal injury during inadvertent contact with the blade yet provide acceptable severing properties with the desired sheet material. Such blades typically comprise a strip of metal (such as tin-plated steel) which has been stamped or die-cut to provide a row of teeth along one edge against which the sheet material is drawn to effect the severing operation. To provide the target level of safety the points of the teeth are typically non-sharpened and radiused to approximately 0.005" or greater. Yet to provide the desired severing properties, tooth spacings are typically designed to approximately 0.040" or greater so that the forces per unit area exerted by each respective tooth are sufficient to penetrate and sever the sheet material.

While such blades have enjoyed acceptance in common use today, their severing performance in-use leaves room for improvement, particularly when used to sever comparatively lower modulus polymeric materials having comparatively greater elongation properties. With such materials, the tensile properties of the material are such that the portions of the sheet material between respective tooth locations tends to stretch and elongate rather than fracture, resulting in incomplete severing of the sheet material, a poor quality line of separation, or, at best, greater than normal tearing forces.

Another recently-developed class of materials for similar applications comprises a three-dimensional, conformable web comprising an active substance such as adhesive on at least one surface protected from external contact by the three-dimensional surface topography of the base material. While severing blades available in the prior art may provide acceptable performance with two-dimensional sheet materials, the increased elongation (apparent low modulus) properties of the three-dimensional materials due to the ability of their three-dimensional structure to translationally deform into a two-dimensional structure within the plane of the material between adjacent blade teeth further increases the likelihood that severing performance will be less than desired.

Accordingly, it would be desirable to provide an improved blade for severing sheet materials which exhibits enhanced severing performance, particularly for comparatively lower modulus materials.

It would further be desirable to provide such an improved blade which provides predictable tearing performance and greater ease of tear initiation, particularly with a wide variety of sheet materials.

It would also be desirable to provide such a blade which may be readily and economically manufactured and utilized in combination with a suitable container for containing and dispensing sheet materials.

SUMMARY OF THE INVENTION

The present invention provides an improved blade for severing sheet materials wherein design parameters for the design of the blade teeth have been tailored for improved severing performance. The blade comprises a blade body and a plurality of individual teeth extending outwardly from the blade body. The teeth each have a finite tooth radius and at least one tooth parameter selected from the group of optimized tooth parameters consisting of a tooth radius less than about 0.005 inches, a tooth pitch of less than about 0.050 inches, and a tooth thickness of less than about 0.006 inches.

In a preferred embodiment of a blade in accordance with the present invention, at least two tooth parameters are selected from the group of optimized tooth parameters, and even more preferably three tooth parameters are selected from the aforementioned group of tooth parameters.

Blades in accordance with the present invention may be unitary or composite structures and may be constructed in accordance with conventional fabrication techniques from a wide variety of commonly-available materials.

Severing blades in accordance with the present invention may be affixed to and utilized in combination with a carton or container of generally conventional design for containing and dispensing a sheet material from a continuous web or utilized independently of a dispensing product container either as a hand-held implement or affixed to any stationary object, depending upon the operating environment. Such blades may be utilized to sever a wide variety of sheet materials, including two- and three-dimensional polymeric sheet materials.

BRIEF DESCRIPTION OF THE DRAWINGS

While the specification concludes with claims particularly pointing out and distinctly claiming the present invention, it is believed that the present invention will be better understood from the following description in conjunction with the accompanying Drawing Figures, in which like reference numerals identify like elements, and wherein:

DETAILED DESCRIPTION OF THE INVENTION

Figure 1:
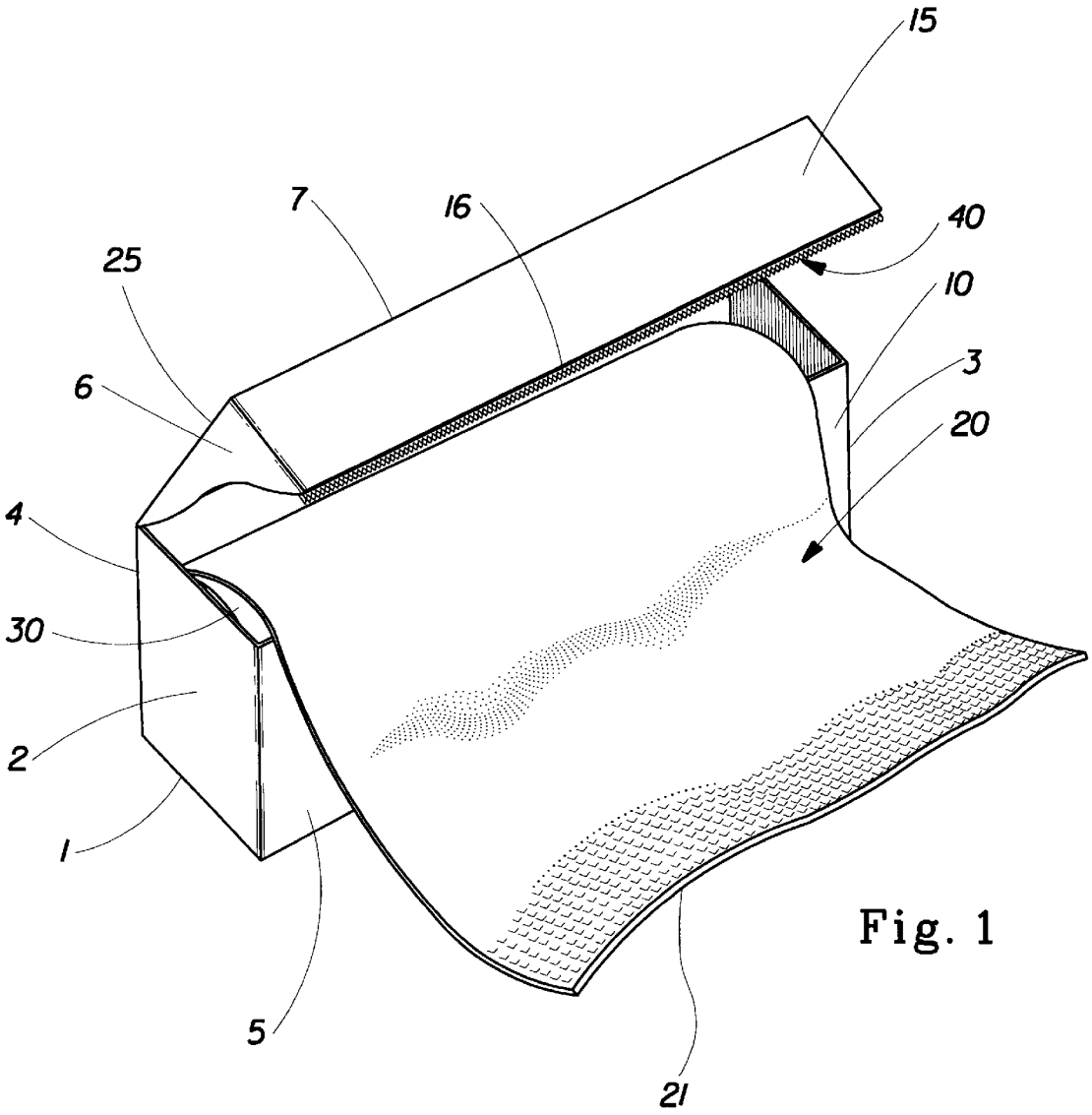
FIG. 1 is a perspective view of a carton for dispensing a web of sheet material with a blade according to the present invention installed thereon.

FIG. 1 depicts a carton 10 of generally conventional design for containing and dispensing a web 20 of sheet material from a roll 30. The carton 10 includes a bottom panel 1, two end panels 2 and 3, and two side panels 4 and 5, as well as a lid 25. In the embodiment shown, the lid 25 includes a flap 15 which overlaps at least a portion of the front side panel 5 when the lid is in the closed configuration. Optional gussets 6 at each end of the lid 25 aid in maintaining the flap 15 in a perpendicular relationship to the top panel 7 of the lid 25. The carton 10 also includes a preferred embodiment of a blade 40 according to the present invention. In the presently preferred (but only representative) configuration shown in FIG. 1, the blade 40 is located on the distal edge 16 of the flap 15 such that the teeth of the blade extend at least slightly outwardly beyond the edge of the flap in overlying relationship to the front side panel 5. In the configuration illustrated in FIG. 1, the blade is affixed to the inner surface of the flap 15 such that the teeth extend outwardly beyond the marginal edge of the flap. If desired, however, the blade 40 according to the present invention may be mounted either on an inside or outside surface of the carton and may be located elsewhere on the carton, such as the lower edge of the front panel 5 of the carton, or utilized independently of a dispensing product container either as a hand-held implement or affixed to any stationary object, depending upon the operating environment.

Cartons of such conventional design are typically fashioned from a cardboard or paperboard material which is cut and folded to form a box-like construction when edges and flaps are secured to one another. The sheet material is frequently wound upon a plastic or cardboard tube to form a cored roll. A wide variety of carton materials and sheet material/roll configurations may be suitable for various applications.

In use, the web of sheet material 20 may be drawn against the blade 40 to sever a desired length of sheet material from the roll when the flap 15 is held in the closed position overlying the front panel 5 of the carton. This arrangement prevents the tail of the rolled material from being lost within the carton after severance of a length of material, since the "tail" or terminal edge of the continuous sheet material created by the severing operation will be held between the flap 15 and the front panel 5. The numeral 21 identifies the terminal edge of the sheet material, which typically comprises the "tail" remaining after the previous severing operation.

Figure 2:
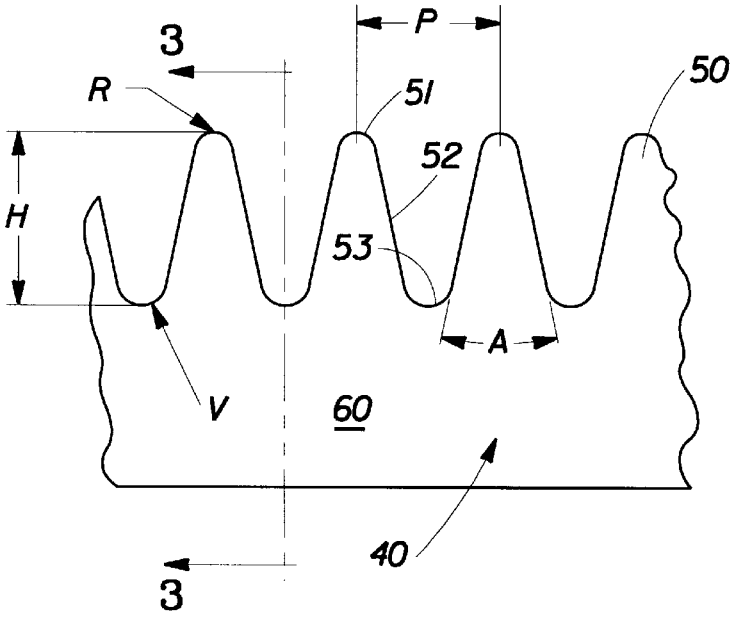
FIG. 2 is an enlarged side view of a portion of a blade in accordance with the present invention.

FIG. 2 is a plan view of a blade 40 according to the present invention, having been greatly enlarged for clarity of illustration. As shown in FIG. 2, the blade 40 has a plurality of teeth 50 extending outwardly from the elongated, substantially linear blade body 60. The blade 40 may be structurally defined (units are length) in terms of the following tooth parameters: the tooth thickness T (seen in FIG. 3), tooth pitch P, tooth height H, tooth radius R, valley radius V, and tooth included angle A (degrees) between tooth sides. The tooth pitch P can also be expressed as a "number density" N by simple inversion so that it is expressed in teeth per unit length rather than simple length units.

Blades in accordance with the present invention utilize tooth design parameters which have been selected and optimized to provide superior severing performance under in-use conditions with a wide variety of materials, particularly comparatively low modulus (low force to elongate) sheet materials and sheet materials of three-dimensional geometry which exhibit a lower modulus than their compositional material would exhibit in two-dimensional form. From the list of defined tooth parameters above, tooth parameters P, R, and T are presently believed to be important in determining successful tooth and blade designs for delivering superior severing performance. Accordingly, blades in accordance with the present invention include teeth designed in accordance with the principles expressed herein and incorporate at least one, more preferably at least two, and most preferably all three of the optimized tooth parameters P, R, and T.

In accordance with the present invention, and as depicted in FIG. 2, the distal portion of each tooth 50 has a finite tooth radius R rather than being sharply pointed. This provides enhanced safety for the user due to the reduced likelihood that a radiused point will penetrate skin tissue when impinged upon or drawn across a body part in comparison with a sharply pointed tooth having an infinitely small (essentially zero) tooth radius. At the same time, the tooth radius R is sufficiently small so as to concentrate the forces upon a small area of the sheet material to provide increased penetration pressure (higher force per unit area) and thus readily penetrate sheet materials to initiate the severing operation. The preferred tooth radius R is in fact significantly smaller than the radii of teeth in current commercially available blades. This in turn increases the effectiveness of the blade in terms of tooth penetration of the material, yet due to the decreased spacing of the teeth along the blade (described below) the blades are believed to exhibit at least a comparable degree of safety and in fact an increased user perception of safety based upon tactile impression. In accordance with the present invention, the tooth radius R is preferably finite but less than about 0.005 inches, more preferably between about 0.0005 inches and about 0.005 inches, still more preferably between about 0.001 inches and about 0.004 inches, and most preferably about 0.002 inches.

In accordance with the present invention, the number of teeth per unit length is substantially higher than that commonly available in the art. Increasing this "number density" N of teeth serves multiple purposes in advantageously improving the performance of such blades in severing sheet materials. First, increasing the number density of teeth reduces the linear distance between adjacent pairs of teeth, which provides better control over the inter-tooth tearing process between penetration locations. Particularly with comparatively higher modulus materials (paper, metallic foils, etc.) this reduces the likelihood that a tear will propagate outside of the desired severing line. Second, with comparatively lower modulus materials such as stretch films or three-dimensional formed films the decreased distance between adjacent teeth reduces the proportional dissipation of tensile forces that occurs when the material yields due to plastic deformation or translational deformation of three-dimensional surfaces, thus providing improved severing performance. Third, particularly since the teeth include a tip radius R which is comparatively smaller than that commonly found in the prior art, the greater number density is believed to reduce the likelihood of personal injury when inadvertent contact occurs because the force exerted by a body part against the blade is distributed over a greater number of individual teeth and hence the penetration pressure (force per unit area) is also correspondingly reduced. This attribute reduces if not eliminates the need for more complex "guarded tooth" blade designs found in the art wherein complex blade shapes are employed to prevent inadvertent contact with sharp blade edges or corners. However, such does not preclude the utilization of guards or guarded blade configurations where desired.

Expressing the number density N in terms of its inverse, tooth pitch P, in accordance with the present invention the tooth pitch P is preferably finite but less than about 0.050 inches, more preferably between about 0.001 inches and about 0.050 inches, still more preferably between about 0.005 inches and about 0.035 inches, and most preferably between about 0.01 inches and about 0.02 inches. A tooth pitch of approximately 0.022 inches has proven satisfactory in use.

The thickness T of the teeth, measured at the tip of the teeth (51), is presently preferred to be thinner than that found in commonly available blades. Since the teeth are preferably non-sharpened, the initial contact area when a sheet material contacts the tooth tip is less than that of commonly available blades. Combined with the reduced tooth tip radius R, this reduced tooth thickness T provides further reduced surface area and hence increased force per unit area (penetration pressure) upon the sheet material for a given exerted force to provide greater ease of initial penetration. This ensures easier starting of the tearing process and more predictable tear-initiating performance. In accordance with the present invention, the tooth thickness T is preferably finite but less than about 0.006 inches, more preferably between about 0.001 inches and about 0.006 inches, still more preferably between about 0.001 inches and about 0.005 inches, and most preferably between about 0.003 inches and about 0.004 inches.

Figure 3:
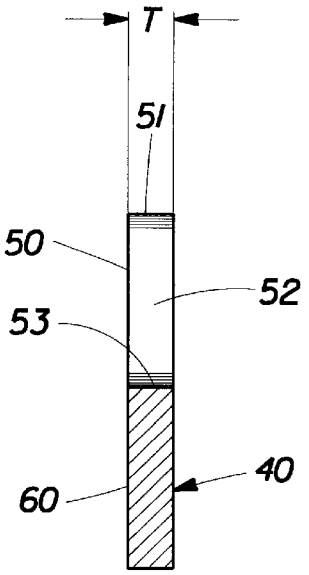
FIG. 3 is an elevational sectional view of the blade of FIG. 2 taken along line 3—3.

In the preferred embodiment depicted in FIGS. 2 and 3, the tooth thickness T is approximately equal to the thickness of the blade body 60 which supports the teeth 50 since the blade is unitarily formed from a piece of stock of uniform overall thickness. However, such need not be the case. Indeed, the tooth thickness could vary from the cross-sectional thickness at the tip (which is the dimensioned tooth thickness T) to the base of the tooth near the valley, and either could differ from the thickness of the blade body. This configuration could be realized whether the blade is unitarily formed or a composite of various components.

Figure 4:
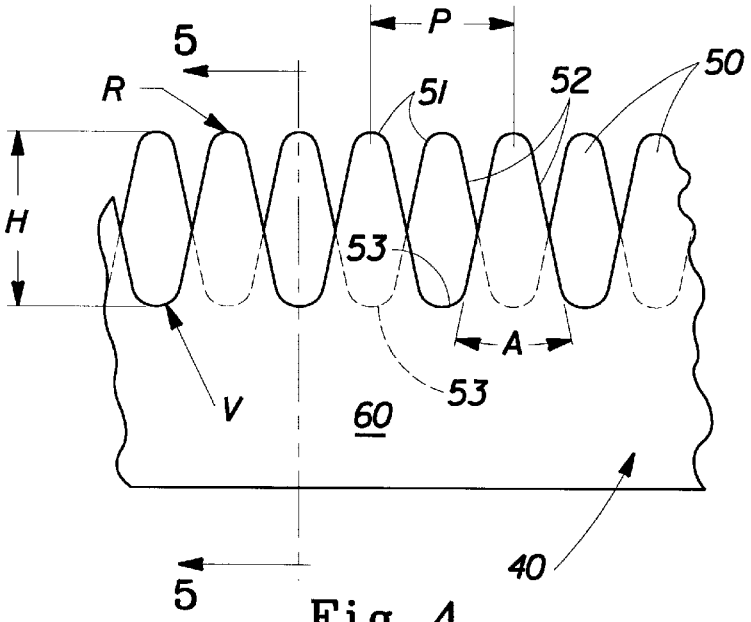
FIG. 4 is an enlarged side view similar to FIG. 3 of a portion of another blade in accordance with the present invention.
Figure 5:
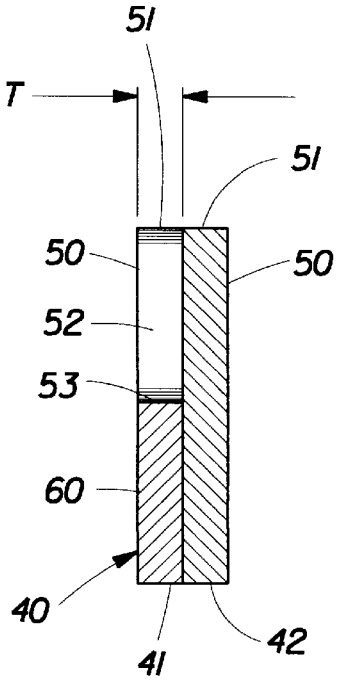
FIG. 5 is an elevational sectional view of the blade of FIG. 4 taken along line 5—5.

FIGS. 4 and 5 depict a composite blade 40 to illustrate just such a configuration. In FIGS. 4 and 5, it can be seen that the blade 40 is a composite of two blade halves or blade elements 41 and 42 similar to the blade 40 depicted in FIGS. 2 and 3 having been co-facially joined (joined side to side) along their length with teeth on respective blade halves being approximately out of phase and forming an alternating pattern of offset teeth. Accordingly, by utilizing two blade halves each with teeth 50 being formed thereon a composite blade structure is formed with teeth having a tooth thickness T which is approximately half of the total blade thickness measured at the lower portion of the blade body 60. Even when two blade halves constructed and dimensioned in accordance with the blade of FIGS. 2 and 3 are utilized, the resulting composite blade of FIGS. 4 and 5 has a pitch of ½ P compared with the blade of FIGS. 2 and 3, yet has the same numerical values for the other parameters such as H, A, V, R, and T. Such a composite blade approach may be useful when manufacturing or economic considerations limit the ability to form teeth below a certain pitch, i.e., if manufacturing considerations limited tooth formation in a unitary blade to a pitch of 0.04 inches a composite blade having a pitch of 0.02 inches could thus be formed.

Composite blades formed in this manner also effectively broaden the permissible range of included angles A which can be utilized for a given tooth pitch P, since the alternate teeth of the two blade elements do not share a common valley between them. For example, in the two blade element illustration presented in FIG. 4 the angle A of FIG. 2 (if utilized in each blade element) produces a composite blade having half the pitch in FIG. 4. Note, however, that in such a composite blade configuration the alternating teeth of the two blade halves would form an offset pattern with the teeth being offset from one another by the dimensional thickness of the components laminated together. Such composite blades could be formed from any desired number of blade elements, such as two, three, four, etc.

Besides the aforementioned tooth parameters P, R, and T which provide the performance advantages in accordance with the present invention, the other defined tooth parameters A, V, and H which are presently believed to play a lesser role in blade severing performance may be adjusted to geometrically control parameters P, R, and T as desired. Said differently, while T may be geometrically independently specified from the other parameters, certain of the other parameters are geometrically dependent upon others. For example, increasing the comparative number density of teeth N (decreasing tooth pitch P) at a given H, R, and V requires a corresponding reduction in the included angle A of each tooth. In another example, increasing the tooth height H while holding N, R, and V constant requires a corresponding decrease in the included angle A of each tooth. Other variable linkages and relationships will be apparent to those of ordinary skill in the art. In accordance with the presently preferred embodiment of a blade according to the present invention, valley radii V have been utilized which are equal in magnitude to the tooth radius R, such as is depicted in FIG. 2. Tooth heights H for reasons of manufacturing expediency and severing performance have been preferred between about 0.010 inches and about 0.050 inches, with a height of about 0.035 inches being presently preferred. Tooth included angles A have been preferred to be finite but less than about 60 degrees, more preferably between about 17.5 degrees and about 37.5 degrees, still more preferably between about 15 degrees and about 25 degrees, and most preferably about 20 degrees. A tooth angle of about 22.5 degrees has proven satisfactory in use.

In addition, it is presently preferred that the teeth 50 be non-sharpened. Said differently, it is presently preferred that the edges 52 of the teeth 50 not be beveled with regard to the normal direction perpendicular to the length of the blade 40. Accordingly, as shown in FIG. 3 the marginal edges of each tooth are substantially perpendicular to the length of the blade. Accordingly, as depicted in FIGS. 2 and 3 the tip 51 of each tooth is in fact in the shape of a curved plane having a finite thickness T equal to the thickness of the material from which the blade is made. Moreover, in the presently preferred configuration wherein the blades are non-sharpened the thickness of each tooth is substantially constant from the bottom of the valley 53 between adjacent teeth, along the "tooth edge" 52, all the way to the tooth tip 51.

With regard to the tooth edge 52, representing the surface of each tooth between its peak and intervening valley, FIGS. 2 and 3 depict a presently preferred configuration typical of commercially available blades wherein the surface defining the tooth edge is essentially substantially planar in shape (linear when viewed from the side). However, under some circumstances it may be appropriate or desirable for the tooth edge to be non-planar and/or curvilinear in shape, with the principles of the present invention believed to be equally applicable in such a configuration.

In order to provide for aesthetically pleasing tearing performance, as depicted in FIG. 3 the teeth preferably lie in a common plane (for a planar, non-curved blade) and exhibit a zero offset. Accordingly, the teeth are not canted outwardly in an alternating pattern as typical reciprocating saw teeth would be, since this would tend to create a ragged tear line in the pattern of the offset teeth and would exert angled tensile forces between adjacent pairs of teeth which would be less likely to precisely align with the desired tearing direction. Moreover, the teeth are also co-planar in the preferred configuration of FIGS. 2 and 3, being co-planar with one another as well as being co-planar with the blade body 60.

As depicted in FIG. 2, it is presently preferred that the spacing between adjacent teeth be substantially constant along the length of the blade, i.e., that the tooth pitch P be substantially constant. This provides increased tearing consistency across the sheet material. However, under some circumstances it may be desirable to provide for a non-constant tooth pitch to modulate the force required for tearing the material at various locations across the web.

Blades in accordance with the present invention may be fabricated from a wide variety of suitable materials, such as metals, plastics, glass, rubber, cardboard, wood, ceramic, etc., in either a homogeneous composition or interspersed or reinforced with other materials. However, for reasons of economy and manufacturing expediency the use of tin-plated steel such as is commonly commercially available is presently preferred. Another currently preferred blade material is plastic, such as polyethylene, polypropylene, polycarbonate, polystyrene, or polyethylene terephthalate (PET). Blades, including individual teeth, need not be unitarily formed as is presently preferred, but may in fact be a composite of multiple blade or tooth sections of similar or dissimilar materials joined to one another to form a composite structure. Blades may also be reusable, disposable, semi-disposable (limited use), or renewable as desired depending upon blade construction and operating environment. Blade materials may be selected to provide the desired level of durability under in-use conditions and with regard to the tearing forces required for particular materials, as well as manufacturing and economic considerations.

The improved blades of the present invention may be manufactured by any suitable method commonly utilized in the art for the particular material desired, such as molding (injection or otherwise), casting, sintering, grinding, stamping, forging, machining, electrical discharge machining, etching, hobbing, etc. A presently preferred method suitable for use with the presently preferred material (tin-plated steel) utilizes a punch and die assembly with both components being suitably formed into the requisite shape and profile. A desired length of blade material is then placed between the punch and die and struck into the finished shape. Note that while the blade may have a single toothed edge as depicted in the Drawing Figures, if a continuous process is utilized with rotating punch elements blades may be formed with two toothed edges as the leading edge of one blade forms the trailing edge of the next one. For blade materials such as plastics, stamping or molding techniques may prove desirable.

Figure 6:
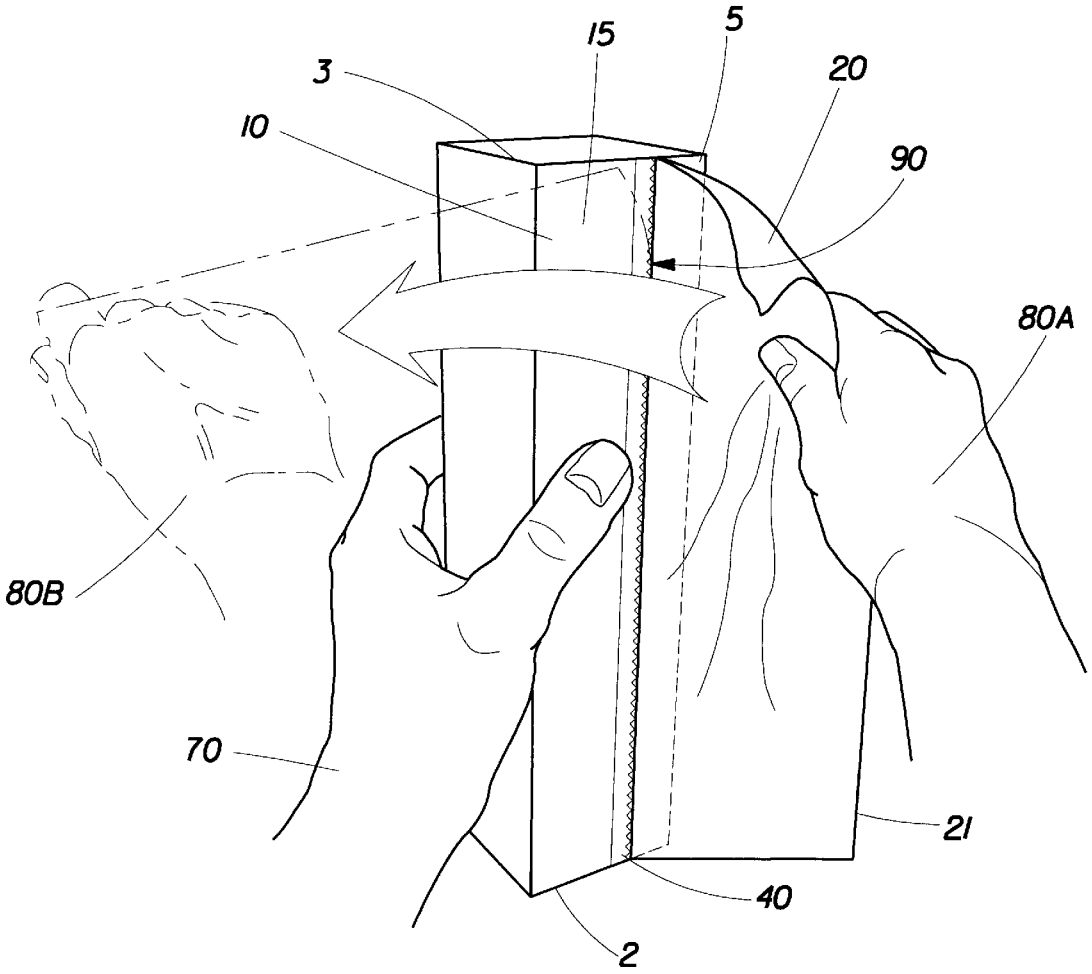
FIG. 6 is a graphical representation of a typical severing operation with a blade in accordance with the present invention.

FIG. 6 depicts a typical in-use scenario wherein a blade according to the present invention is utilized to sever a desired length of sheet material from a roll of stock material. As shown in FIG. 6, a carton 10 of the type depicted in FIG. 1 is held in a closed condition in one hand 70 while the other hand grasps the terminal edge 21 of the sheet material 20. The terminal edge 21 of the sheet material is drawn outwardly until the desired length (relative to the location of the blade 40) of the sheet material extends outwardly from the roll 30 between the blade and the front panel 5. At this point the hand reaches the location depicted by hand 80A. The grasping action of hand 70 aids in pinching the lid 15 against the front panel 5 to reduce the likelihood that the severing operation will cause the sheet material to slip relative to the blade.

To accomplish the severing of the length of sheet material, the terminal edge 21 of the sheet material is pulled back over the location of the blade 40 as indicated by the large arrow in FIG. 6 such that the material partially wraps the blade 40 and the material is drawn at an angle toward the user and upwardly from the direction of the carton 40. At this time, the hand 80A crosses over the hand 70 and reaches the location depicted by hand 80B as the tearing process progresses. Drawing the sheet material back across the blade at an angle concentrates the pulling force at the edge of the sheet material near the carton end panel 3 such that the force per unit area exerted by the sheet material over the blade teeth exceeds the penetration pressure required to pierce the sheet material. The numerical identifier 90 identifies the location of the leading edge of the tear line which is progressing downwardly in the illustration from the upper edge of the sheet material downwardly along the blade toward the lower edge of the material. The sheet material located along the tear line below the location 90 may be under little or no tension while the tension near the location 90 is maintained in excess of the required penetration pressure. When the tear line reaches the farthest edge of the material near the carton end panel 2, the separation is complete and a new terminal edge 21 is formed on the remaining sheet material at the location of the toothed side of the blade.

Blades in accordance with the present invention may be utilized in the severing of a wide variety of sheet-like materials, whether in web, sheet, rolled, or continuous forms, of such various compositions as polyvinyl chloride (PVC), polyvinylidene chloride (PVDC), polyethylene (PE), polypropylene (PP), aluminum foil, coated (waxed, etc.) and uncoated paper, etc., whether predominantly two-dimensional in nature or formed into three-dimensional structures. Such materials may comprise a single composition or layer or may be a composite structure of multiple materials, including a substrate material utilized as a carrier for a substance.

One material of current interest comprises a three-dimensional, conformable web comprising an active substance such as adhesive on at least one surface protected from external contact by the three-dimensional surface topography of the base material. Such materials comprise a polymeric or other sheet material which is embossed/debossed to form a pattern of raised "dimples" on at least one surface which serve as stand-offs to prevent an adhesive therebetween from contacting external surfaces until the stand-offs are deformed to render the structure more two-dimensional. The ability of such a three-dimensional structure to translationally deform into a two-dimensional structure under tension within the plane of the material produces an increased elongation (apparent low modulus) property compared with the modulus the same compositional material would exhibit in two-dimensional form. Representative adhesive carrier structures include those disclosed in commonly assigned, co-pending U.S. patent application Ser. Nos. 08/584,638, filed Jan. 10, 1996 in the names of Hamilton and McGuire, entitled "Composite Material Releasably Sealable to a Target Surface When Pressed Thereagainst and Method of Making", 08/744,850, filed Nov. 8, 1996 in the names of Hamilton and McGuire entitled "Material Having A Substance Protected by Deformable Standoffs and Method of Making", 08/745,339, filed Nov. 8, 1996 in the names of McGuire, Tweddell, and Hamilton, entitled "Three-Dimensional, Nesting-Resistant Sheet Materials and Method and Apparatus for Making Same", 08/745,340, filed Nov. 8, 1996 in the names of Hamilton and McGuire, entitled "Improved Storage Wrap Materials". Other suitable materials include two-dimensional adhesive-bearing polymeric, metallic, fibrous, and paper tapes, wraps, and the like suitable for fastening, securing, or wrapping various items.

While much of the foregoing discussion has focused upon the presently preferred configuration of the blade wherein the blade is substantially planar and linear, it is to be understood that the design principles of the present invention may also be applied to great advantage for blades which are curvilinear in shape and/or non-planar. That is to say, the blade could be curved both in the plane normal to the direction in which the teeth extend and within the plane parallel to the direction in which the teeth extend. Blades could also be comprised of multiple blade segments of curvilinear or straight configuration, or could form one or more angles of straight segments within such planes, or any combination thereof.

At the same time, while the presently preferred configurations depicted in FIGS. 2 and 3 depict blades wherein the teeth extend outwardly from the blade with each tooth oriented so that adjacent teeth, and preferably all teeth, are co-planar with one another and co-planar with the body of the blade, teeth could also be employed which extend outwardly at some other angle than normal to the tangent of the blade and either uniformly or non-uniformly out of the plane of the blade. Teeth could also be employed wherein the teeth are non-symmetrical about their tooth point such that the two edges of each tooth are of unequal length, unlike the preferred configuration depicted in FIGS. 2–5 wherein the edges of each tooth are of substantially equal length.

While particular embodiments of the present invention have been illustrated and described, it would be obvious to those skilled in the art that various other changes and modifications can be made without departing from the spirit and scope of the invention. It is therefore intended to cover in the appended claims all such changes and modifications that are within the scope of this invention.

What is claimed is:

1. A blade for severing sheet materials, said blade comprising a blade body and a plurality of individual teeth extending outwardly from said blade body, said teeth each having a finite tooth radius and at least one tooth parameter selected from the group consisting of a tooth radius less than about 0.005 inches, a tooth pitch of less than about 0.050 inches, and a tooth thickness of less than about 0.006 inches, and combinations thereof.

2. The blade of claim 1, wherein said teeth are substantially non-sharpened.

3. The blade of claim 1, wherein said teeth each have at least two tooth parameters selected from the group consisting of a tooth radius less than about 0.005 inches, a tooth pitch of less than about 0.050 inches, and a tooth thickness of less than about 0.006 inches, and combinations thereof.

4. The blade of claim 1, wherein said teeth each have three tooth parameters selected from the group consisting of a tooth radius less than about 0.005 inches, a tooth pitch of less than about 0.050 inches, and a tooth thickness of less than about 0.006 inches, and combinations thereof.

5. The blade of claim 1, wherein said teeth have a tooth pitch of between about 0.001 inches and about 0.050 inches.

6. The blade of claim 5, wherein said teeth have a tooth pitch of between about 0.005 inches and about 0.035 inches.

7. The blade of claim 6, wherein said teeth have a tooth pitch of between about 0.01 inches and about 0.02 inches.

8. The blade of claim 1, wherein said teeth have a tooth thickness of between about 0.001 inches and about 0.006 inches.

9. The blade of claim 8, wherein said teeth have a tooth thickness of between about 0.003 inches and about 0.004 inches.

10. The blade of claim 1, wherein said teeth have a tooth radius of between about 0.0005 inches and about 0.005 inches.

11. The blade of claim 10, wherein said teeth have a tooth radius of between about 0.001 inches and about 0.004 inches.

12. The blade of claim 11, wherein said teeth have a tooth radius of about 0.002 inches.

13. The blade of claim 1, wherein said blade is substantially planar.

14. The blade of claim 1, wherein adjacent teeth are co-planar with one another and with said blade body.

15. The blade of claim 1, wherein said teeth have substantially planar tooth edges.

16. The blade of claim 1, wherein said blade comprises a metallic or plastic material.

17. The blade of claim 1, wherein said teeth are unitarily formed with said blade.

18. The blade of claim 1, wherein said blade comprises a plurality of blade elements co-facially joined with one another, each blade element comprising a plurality of teeth, such that teeth of respective blade element form an alternating pattern of offset teeth.

19. A blade for severing sheet materials, said blade comprising a blade body and a plurality of individual substantially non-sharpened teeth unitarily formed with and extending outwardly from said blade body, said teeth each having a tooth radius of about 0.002 inches, a tooth pitch of between about 0.01 inches and about 0.02 inches, and a tooth thickness of between about 0.003 inches and about 0.004 inches.

20. A carton for containing and dispensing a sheet material, said carton comprising:

(a) a substantially enclosed carton having two side walls, two end walls, a bottom wall, and a lid;

(b) a web of sheet material contained within said carton; and (c) a blade for severing sheet materials, said blade comprising a blade body and a plurality of radiused, non-sharpened teeth extending outwardly from said blade body, said teeth each having at least one tooth parameter selected from the group consisting of a tooth radius less than about 0.005 inches, a tooth pitch of less than about 0.050 inches, and a tooth thickness of less than about 0.006 inches, and combinations thereof, said blade being affixed to said carton such that said sheet material may be contacted with said blade when a portion of said sheet material is drawn out of said carton to sever said portion from a remaining portion of said sheet material within said carton.

* * * * *